US009816293B2

(12) United States Patent
Min et al.

(10) Patent No.: US 9,816,293 B2
(45) Date of Patent: Nov. 14, 2017

(54) ELECTRICAL CONTROL LOCK DEVICE

(71) Applicant: GRG Banking Equipment Co., Ltd., Guangzhou, Guangdong (CN)

(72) Inventors: Sizong Min, Guangzhou (CN); Gaofeng Du, Guangzhou (CN); Yuxuan Xie, Guangzhou (CN); Xiaojun Huang, Guangzhou (CN); Zhihui Lei, Guangzhou (CN)

(73) Assignee: GRG Banking Equipment Co., Ltd., Guangzhou, Guangdong (CN)

( * ) Notice: Subject to any disclaimer, the term of this patent is extended or adjusted under 35 U.S.C. 154(b) by 477 days.

(21) Appl. No.: 14/416,619

(22) PCT Filed: Mar. 28, 2013

(86) PCT No.: PCT/CN2013/073306

§ 371 (c)(1),
(2) Date: Jan. 22, 2015

(87) PCT Pub. No.: WO2014/036826

PCT Pub. Date: Mar. 13, 2014

(65) Prior Publication Data

US 2015/0176310 A1 Jun. 25, 2015

(30) Foreign Application Priority Data

Sep. 5, 2012 (CN) ..... 2012 1 0326293

(51) Int. Cl.
*E05B 47/00* (2006.01)
*E05B 47/02* (2006.01)
(Continued)

(52) U.S. Cl.
CPC ..... *E05B 47/0012* (2013.01); *E05B 47/02* (2013.01); *E05B 47/0669* (2013.01);
(Continued)

(58) Field of Classification Search
CPC .. E05B 47/0012; E05B 47/02; E05B 47/0669; E05B 83/34; E05B 83/28; E05B 2047/0069
See application file for complete search history.

(56) References Cited

U.S. PATENT DOCUMENTS 1,611,838 A 12/1926 Malicki
5,018,375 A * 5/1991 Tully ..... E05B 47/068 292/144

(Continued)

FOREIGN PATENT DOCUMENTS

CN 1224107 A 7/1999
CN 2679306 Y 2/2005

(Continued)

OTHER PUBLICATIONS

International Search Report dated Oct. 24, 2013 from corresponding International Application PCT/CN2013/073306.

(Continued)

*Primary Examiner* — Zeev V Kitov
(74) *Attorney, Agent, or Firm* — Wolf, Greenfield & Sacks, P.C.

(57) ABSTRACT

An electrical control lock device comprises: a safety casing which is provided at least one cover body; a rotating shaft, which is connected fixedly with a locked part and drives the locked part outside the casing to rotate, is provided in the casing; a locking plate which is perpendicular to said rotating shaft is arranged fixedly on the rotating shaft, and said locking plate is provided with a pin control portion; a lock pin which selectively drops into the pin control portion and said lock pin is driven by a power motor to rotate; and a control portion which controls the rotating of the power motor according to a guiding control instruction in order that
(Continued)

the lock pin drops into the pin control portion to enable that the locking plate and the locked part are locked.

11 Claims, 5 Drawing Sheets

(51) Int. Cl.
*E05B 47/06* (2006.01)
*E05B 83/34* (2014.01)
*E05B 83/28* (2014.01)

(52) U.S. Cl.
CPC ..... *E05B 83/28* (2013.01); *E05B 83/34* (2013.01); *E05B 2047/0069* (2013.01)

(56) References Cited

U.S. PATENT DOCUMENTS

| | | | | |
|---|---|---|---|---|
| 5,813,257 | A * | 9/1998 | Claghorn | E05B 5/003 292/201 |
| 6,032,416 | A | 3/2000 | Springer et al. | |
| 6,505,867 | B1 | 1/2003 | Szablewski et al. | |
| 2008/0190155 | A1* | 8/2008 | Kim | E05B 65/104 70/431 |
| 2008/0303290 | A1 | 12/2008 | Yuan | |

FOREIGN PATENT DOCUMENTS

| | | | |
|---|---|---|---|
| CN | 101705772 | A | 5/2010 |
| CN | 201598912 | U | 10/2010 |
| CN | 202152572 | U | 2/2012 |
| CN | 102817505 | A | 12/2012 |
| EP | 1122385 | A1 | 8/2001 |
| JP | 2004107983 | A | 4/2004 |
| JP | 2012097503 | A | 5/2012 |
| WO | WO 2006/112630 | A1 | 10/2006 |

OTHER PUBLICATIONS

Extended European Search Report, dated Apr. 4, 2016, from corresponding European Patent Application No. 13835258.8.

* cited by examiner

ELECTRICAL CONTROL LOCK DEVICE

The present application is the national phase of International Application No. PCT/CN2013/073306, filed on Mar. 28, 2013, which claims the benefit of Chinese Patent Application No. 201210326293.3, titled "ELECTRICALLY CONTROLLED LOCKING APPARATUS" and filed with the Chinese State Intellectual Property Office on Sep. 5, 2012, which applications are hereby incorporated by reference to the maximum extent allowable by law.

FIELD OF THE INVENTION

The present application relates to a locking apparatus, and particularly to an electrically controlled locking apparatus for an oil port cover of an oil tank truck.

BACKGROUND OF THE INVENTION

With the popularization of cars in our country, fuel consumption has been greatly increased. Accordingly, the amount of fuel transported by oil tank trucks, as the core of the supply chain of gas stations and fuel consuming sites, has been greatly increased. Due to the high fuel price, recently, loopholes in oil tank truck management have been exploited by lawbreakers in their illegal activities. Apparently, since oil tank trucks are running on the road in most of the times, it is more difficult to ensure the operation security of the oil tank trucks than that of warehouses.

For solving these problems, supervisory departments progressively enhance management and technical measures to prevent such incidents. In the prior art, generally, physical label seal, electronic label seal or padlocks are used to restrict manually opening and closing the oil port. The principles of these preventive measures for restricting the illegal operations are as follows.

1. The physical label seal is to seal the oil port via a disposable label, and only the staff of the oil company are allowed to break the label in operation, thus if the label is broken by other people, it means that something wrong occurs.

2. The electronic label seal is to seal the oil port via an electronic label, which has the same working process as the physical label seal, and corresponding technical measures are required to break the electronic label seal.

3. The lock is a most simple padlock, and keys are kept by the staff of the oil company.

However, in view of the principles of the above measures, the lock and the physical label seal are easy to be destroyed and duplicated, and the electronic label seal may be disabled by lawbreakers by shorting out the electronic label seal or by other means. It is obvious that each of these measures has security flaws which can not be solved.

1. If the preventive measures are disabled, there is no system that can detect the destruction action.

2. The preventive measures rely on artificial operations excessively, and has to be combined with management method to be effective, thus there is a high risk of the managerial personnel being united to cheat.

3. The preventive measures do not have function of active defense, and has to rely on the staff operating by following specification.

Therefore, it is urgent to provide an electrically controlled locking apparatus for an oil port cover of an oil tank truck, which is not easy to be disabled and duplicated and is safe and reliable, so as to fundamentally prevent unlawful actions.

SUMMARY OF THE INVENTION

An object of the present application is to provide an electrically controlled locking apparatus for an oil port cover of an oil tank truck, which is not easy to be disabled or duplicated, and is safe and reliable.

The electrically controlled locking apparatus provided by the present application includes a safety housing provided with at least one cover; a rotating shaft provided in the housing, the rotating shaft being fixedly connected to a component to be locked and being configured to drive the component to be locked outside the housing to rotate; a locking sheet fixedly provided on the rotating shaft, the locking sheet being perpendicular to the rotating shaft and being provided with a pin control portion; a locking pin being configured to selectively engage with the pin control portion and being driven to rotate via a power motor; and a control portion being configured to control a rotation of the power motor according to a control instruction, such that the locking pin is controlled to be engaged with the pin control portion to lock the locking sheet and the component to be locked, or to be disengaged from the pin control portion to unlock the locking sheet and the component being locked.

Preferably, the locking sheet is a semicircular locking plate.

Further, the pin control portion is a notch provided at an edge of the semicircular locking plate for receiving the locking pin.

Preferably, the locking pin is fixed on a pin shaft, the pin shaft is driven by a driven wheel, and the driven wheel is engaged with a driving wheel driven by the power motor.

Further, an end, away from the locking sheet, of the pin shaft is fixedly connected with a blocking sheet.

Further, a blocking sheet detecting sensor is provided at each of two ends of a stroke of the blocking sheet rotating together with the pin shaft.

Preferably, an opening/closing state monitoring device is provided between the cover and the housing.

Further, the opening/closing state monitoring device includes a supporting plate and a self-returning pressing sheet mounted on a surface, facing the cover, of the supporting plate;

the self-returning pressing sheet is rotatably provided on the supporting plate via a rotating shaft, and includes one end extending towards the cover and forming a pressing end and the other end forming a detecting end; the rotating shaft is located between the pressing end and the detecting end; and a detecting sensor is provided in a stroke of the detecting end rotating around the rotating shaft.

Further, the self-returning pressing sheet realizes a self-returning function via a torsion spring coaxially provided relative to the self-returning pressing sheet.

Preferably, the control portion sends an operation instruction or an alarm signal according to a signal sent from the blocking sheet detecting sensor or the opening/closing state monitoring device.

Compared with the prior art, the electrically controlled locking apparatus provided by the present application has the following advantageous.

The apparatus may monitor and control the legal operation via the control portion, so as to effectively restrain illegal destruction and duplication, effectively monitor the state of the cover being not closed or being not fully closed, and avoid the potential risk caused by the electrically controlled locking apparatus being destroyed, thereby greatly preventing the oil tank truck from being illegally opened and preventing oil being stolen during the transportation.

DETAILED DESCRIPTION OF THE INVENTION

The technical solutions in the embodiments of the present application will be described clearly and completely hereinafter in conjunction with the drawings in the embodiments of the present application. Apparently, the described embodiments are only a part of the embodiments of the present application, rather than all embodiments. Based on the embodiments in the present application, all of other embodiments, made by the person skilled in the art without any creative efforts, fall into the protection scope of the present application.

Figure 1:
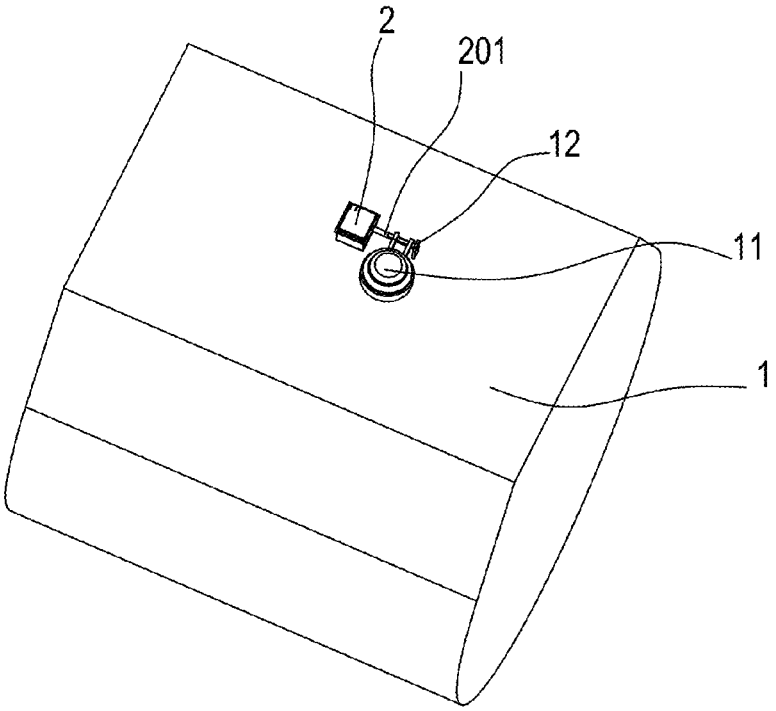
FIG. 1 is a schematic view showing an electrically controlled locking apparatus provided by the present application being used on an oil tank.
Figure 2:
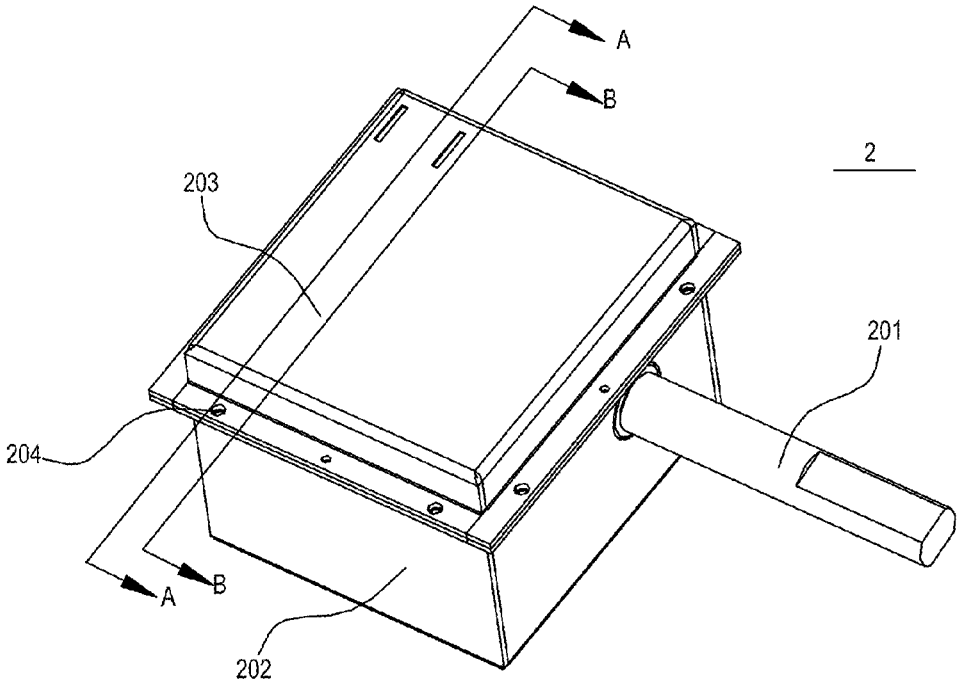
FIG. 2 is a perspective schematic view of an electrically controlled locking apparatus.
Figure 3:
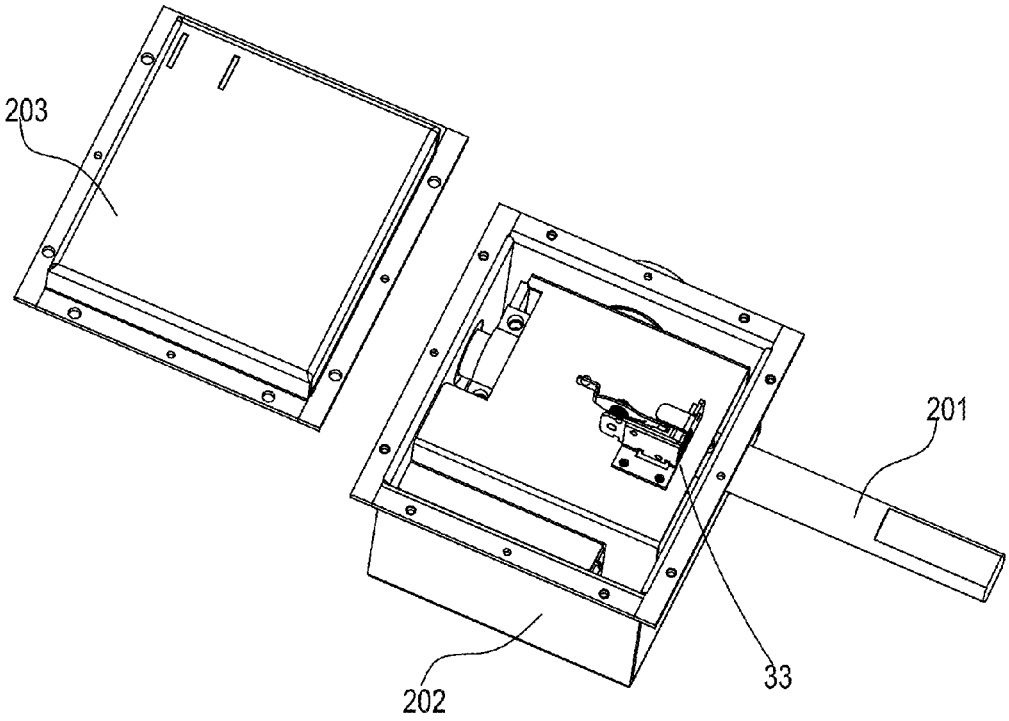
FIG. 3 is an exploded schematic view of the electrically controlled locking apparatus with a cover being opened.
Figure 4:
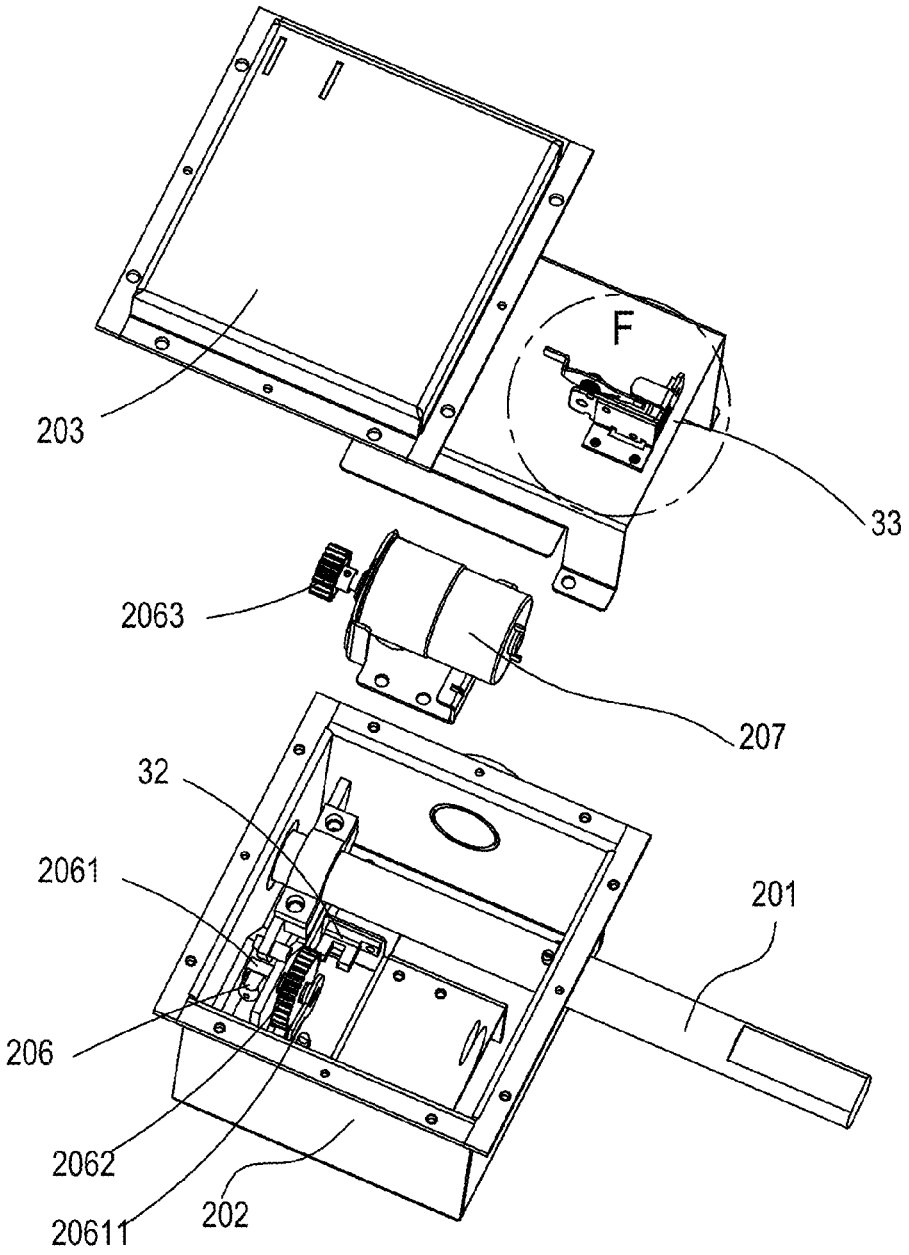
FIG. 4 is an exploded schematic view showing an internal structure of the electrically controlled locking apparatus.

Referring to FIG. 1, an electrically controlled locking apparatus 2 is provided at an oil port of an oil tank 1 for controlling opening and closing of an oil port cover 11, wherein FIG. 1 is only an illustrational view. It is well known that the oil tank 1 carried on a practical oil tank truck has a plurality of oil ports including oil inlets and oil outlets, thus a plurality of the electrically controlled locking apparatus 2 can be directly mounted at the oil inlets and the oil outlets of the oil tank 1 carried on the oil tank truck respectively.

Specifically, the oil port cover 11 is fixedly sleeved on a rotating shaft 201 extended out of the electrically controlled locking apparatus 2, and the rotating shaft 201 includes a tail end movably connected to, via a bearing, a fixed wall 12 fixed on an outer surface of a housing of the oil tank. To avoid cheating, in installation, the electrically controlled locking apparatus 2 and the oil port cover 11 are integrally connected via a bolt or by welding, and also the electrically controlled locking apparatus 2 and the outer surface of the housing of the oil tank 1 are integrally connected via a bolt or by welding.

Referring to FIGS. 2 to 6, an internal structure of the electrically controlled locking apparatus will be further illustrated by dividing it into parts. An external part of the electrically controlled locking apparatus includes a housing 202 and a cover 203 which are made from pressed steel plate. The housing 202 and the cover 203 are connected via a bolt 204 to close the housing 202, and a sealing ring is provided between the housing 202 and the cover 203, thereby forming a sealed cavity which is dustproof, waterproof, electromagnetic radiation-proof and explosion-proof. A rotating shaft 201 is provided in the housing 202, and the rotating shaft 201 is fixedly connected to the oil port cover 11 to be locked and may drive the oil port cover 11 to be locked outside the housing 202 to rotate. A locking sheet 205 perpendicular to the rotating shaft 201 is fixedly provided on the rotating shaft 201 and is provided with a pin control portion 2051. A locking pin 206 is further provided to selectively engage with the pin control portion 2051, and the locking pin 206 is driven by a power motor 207 to rotate. A control portion (not shown) is further provided to control the rotation of the power motor 207 according to a control instruction, such that the locking pin 206 is controlled to be engaged with the pin control portion 2051 to lock the locking sheet 205 and the oil port cover 11 to be locked, or to be disengaged from the pin control portion 2051 to unlock the locking sheet 205 and the locked oil port cover 11. Additionally, for electrically connecting the control portion to a main control system of a vehicle, a wire outlet hole for protruding of an electrical wire and a shaft outlet hole for protruding of the rotating shaft are provided at a side wall of the housing 202. These holes are provided with sealing rings to be dustproof and waterproof.

Figure 5:
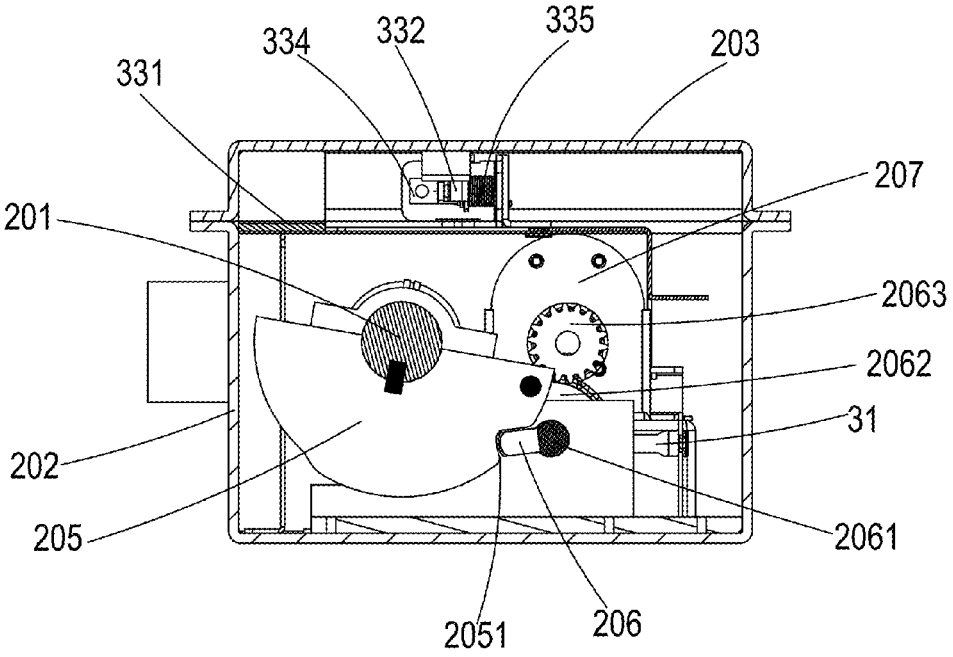
FIG. 5 is a sectional view of the electrically controlled locking apparatus shown in FIG. 2 taken along line A-A.
Figure 6:
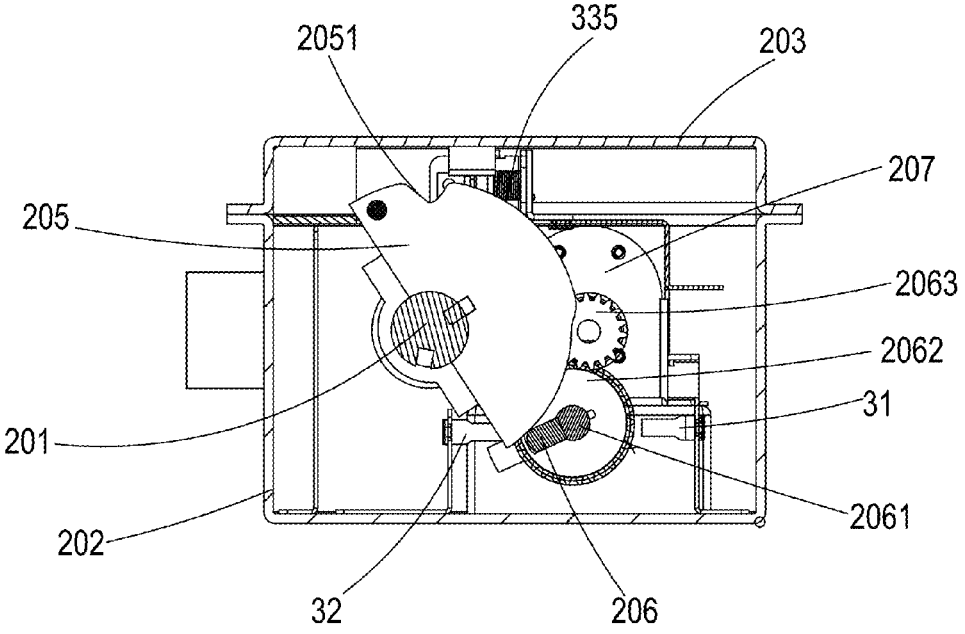
FIG. 6 is a sectional view of the electrically controlled locking apparatus shown in FIG. 2 taken along line B-B.

In particularly, referring to FIG. 5 and FIG. 6, the locking sheet 205 fixedly and perpendicularly provided on the rotating shaft 201 is a semicircular locking plate. A notch 2051 for receiving the locking pin 206 is provided at an edge of the semicircular locking plate. The locking pin 206 is fixed on a pin shaft 2061, and the pin shaft 2061 is driven by a driven wheel 2062 which is engaged with a driving wheel 2063 driven by the power motor 207. Working principle of the electrically controlled locking apparatus 2 will be further explained according to two position states of the locking sheet 205 shown in FIGS. 5 and 6. FIG. 5 is a schematic drawing showing the position state of the locking sheet 205 when the oil port is closed by the oil port cover 11, and at this point, the oil port cover 11 which is coaxially rotated with the locking sheet 205 is located at a position where the oil port is completely covered by the oil port cover 11. Since the oil port cover 11 is coaxially rotated together with the locking sheet 205, when opening or closing the oil port cover 11, the rotating shaft 201 is driven by the oil port cover 11 to rotate, such that the locking sheet 205 is rotated together with the rotating shaft 201. When the oil port cover 11 is fully closed, the notch 2051 on the locking sheet 205 arrives at a predetermined position, and at this point, the control portion controls the power motor 207 to rotate, so as to drive the locking pin 206 to engage with the notch 2051, thereby realizing the purpose of locking the locking sheet 205. After being locked, the locking sheet 205 can not rotate, thus the rotating shaft 201 can not rotate either, thereby realizing the function of locking the oil port cover 11. If it is required to open the oil port cover 11, the control portion controls the power motor 207 to rotate in the opposite direction, so as to drive the pin shaft 206 to rotate and to be disengaged from the notch 2051, thereby realizing the purpose of unlocking the locking sheet 205. When the locking sheet 205 is in an unlocked state, the locking sheet 205 can rotate freely, thus the rotating shaft 201 can also rotate freely, such that a function of unlocking the oil port cover 11 may be realized. The relationships between the components after being unlocked are shown in FIG. 6.

Furthermore, for monitoring the opening/closing state of the corresponding oil port cover 11, a locking sensor 31 and an opening sensor 32 for monitoring the locking pin 206 and an opening/closing state sensor 33 for monitoring the cover 203 are provided in the electrically controlled locking apparatus 2. In particular, an end, away from the locking sheet 205, of the pin shaft 2061 is fixedly connected with a blocking sheet 20611. Two blocking sheet detecting sensors (i.e. the locking sensor 31 and the opening sensor 32) are respectively provided at two ends of a stroke of the blocking sheet 20611 rotating together with the pin shaft 2061. The locking sensor 31 is provided at such a position that when the locking pin 206 is engaged with the notch 2051 for receiving the locking pin 206, the blocking sheet 20611 enters the range of a U-shaped sensor of the locking sensor 31. The opening sensor 32 is provided at such a position that when the locking pin 206 is completely disengaged from the notch 2051 for receiving the locking pin 206, the blocking sheet 20611 enters the range of a U-shaped sensor of the opening sensor 32. Thus, if it is required to open the oil port cover 11, the control portion sends an instruction of opening, and the power motor 207 begins to rotate and drives the locking pin 206 to be disengaged from the notch 2051. Then, the blocking sheet 20611 which is also located on the pin shaft 2061 as the locking pin 206 may rotate together with the pin shaft 2061 to leave the range of the locking sensor 31. At this point, the locking sensor 31 may sense the leaving of the blocking sheet 20611 and informs the control portion of the detected state. Then, when the blocking sheet 20611 arrives in the range of the U-shaped sensor of the opening sensor 32, the opening sensor 32 may sense the arriving of the blocking sheet 20611 and informs the control portion of the detected state. Then, according to the signal from the opening sensor 32, the control portion sends an instruction of stopping the power motor 207, and the power motor 207 stops immediately. At this time, the electrically controlled locking apparatus 2 is in an unlocked state, thus the oil port cover 11 can be opened. When it is required to close the oil port cover 11, firstly, the oil port cover 11 is fully closed relative to the oil tank, and at this time the notch 2051 of the locking sheet 205 on the rotating shaft 201 is in a locking position, then the control portion sends an instruction of locking. After receiving the instruction, the power motor 207 begins to rotate and drives the locking pin 206 and the blocking sheet 20611 to rotate together. When the blocking sheet 20611 leaves the range of the opening sensor 32, the opening sensor 32 informs the control portion of the detected state. Finally, when the locking pin 206 is engaged with the notch 2051, that is the blocking sheet 20611 arrives the range of the locking sensor 31, the locking sensor 31 detects the arriving of the blocking sheet 20611 and informs the control portion of the detected state information. According to the signal from the locking sensor 31, the control portion sends an instruction of stopping the power motor 207, and the power motor 207 stops immediately. At this point, the electrically controlled locking apparatus is in a locked state, and the oil port cover can not be opened.

In the case that the oil port cover 11 is not fully closed, or someone intentionally instructs to lock when the oil port cover is not fully closed, the locking sheet 205 is in the unlocking position due to the fact that the oil port cover is not fully closed, and the locking pin 206 can not make the predetermined stroke due to the fact that the locking sheet 205 is not at the right position, i.e. the notch 2051 is not at the proper position, therefore the blocking sheet 20611 can not rotate into the range of the locking sensor 31 within the specific time. At this time, the control portion may send a warning instruction due to the timeout of the locking operation, thus the administrator may immediately knows that an abnormal situation occurs on the oil port.

Figure 7:
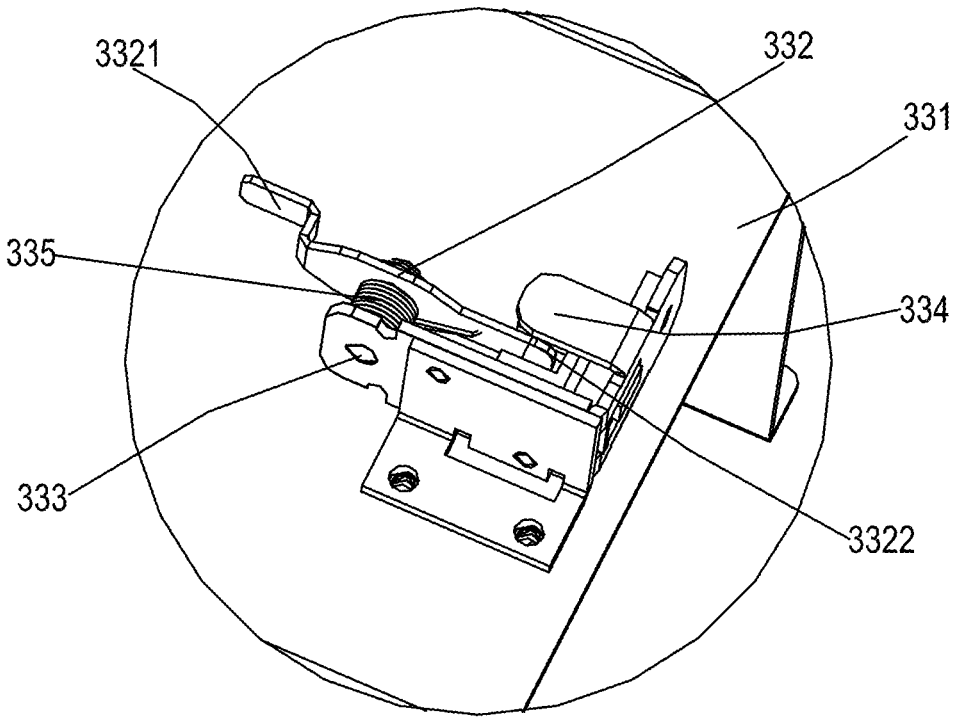
FIG. 7 is a partial enlarged drawing of an area "F" in FIG. 4.

Furthermore, referring to FIG. 7, in order to monitor illegal destruction of the electrically controlled locking apparatus 2, an opening/closing state sensor 33 is provided between the cover 203 and the housing 202. The opening/closing state sensor 33 can monitor the opening and closing states of the cover 203 of the electrically controlled locking apparatus. The opening/closing state sensor 33 includes a supporting plate 331 and a self-returning pressing sheet 332 mounted on a surface, facing the cover 203, of the supporting plate 331. The self-returning pressing sheet 332 is rotatably provided on the supporting plate 331 via a rotating shaft 333, and has one end extending towards the cover and forming a pressing end 3321 and the other end forming a detecting end 3322. The rotating shaft 333 is located between the pressing end 3321 and the detecting end 3322. A detecting sensor 334 is provided in a stroke of the detecting end 3322 rotating around the rotating shaft 333. The self-returning pressing sheet 332 realizes the self-returning function via a torsion spring 335 coaxially provided relative to the self-returning pressing sheet 332.

When the cover 203 is opened, the self-returning pressing sheet 332 is not subjected to the force from the cover 203, and under the action of the torsion spring 335, the detecting end 3322 of the self-returning pressing sheet 332 leaves the range of the detecting sensor 334. Then, the detecting sensor 334 informs the control portion of state information of the leaving of the detecting end 3322, and a background is informed immediately that the cover 203 has been opened. If the cover 203 is closed, the pressing end 3321 of the self-returning pressing sheet 332 is pressed down by the cover 203, and the detecting end 3322 is raised into the range of the detecting sensor 334, then the detecting sensor 334 informs the control portion of state information of the arriving of the detecting end 3322, and the control portion is immediately informed that the cover has been closed. Due to the opening/closing state sensor 33, an object that the electrically controlled locking apparatus can not be disassembled without permission can be realized.

The above-described embodiments are only preferred embodiments of the present application. It should be noted that, for the person skilled in the art, many modifications and improvements may be made to the present application without departing from the principle of the present application, and these modifications and improvements are also deemed to fall into the protection scope of the present application.

The invention claimed is:

1. An electrically controlled locking apparatus, comprising:

a safety housing provided with at least one cover;

a rotating shaft provided in the housing, the rotating shaft being fixedly connected to a component to be locked and being configured to drive the component to be locked outside the housing to rotate;

a locking sheet fixedly provided on the rotating shaft, the locking sheet being perpendicular to the rotating shaft and being provided with a pin control portion;

a locking pin being configured to selectively engage with the pin control portion and being driven to rotate via a power motor; and a control portion being configured to control a rotation of the power motor according to a control instruction, such that the locking pin is controlled to be engaged with the pin control portion to lock the locking sheet and the component to be locked, or to be disengaged from the pin control portion to unlock the locking sheet and the component being locked.

2. The electrically controlled locking apparatus according to claim 1, wherein the locking sheet is a semicircular locking plate.

3. The electrically controlled locking apparatus according to claim 2, wherein the pin control portion is a notch provided at an edge of the semicircular locking plate for receiving the locking pin.

4. The electrically controlled locking apparatus according to claim 1, wherein the locking pin is fixed on a pin shaft, the pin shaft is driven by a driven wheel, and the driven wheel is engaged with a driving wheel driven by the power motor.

5. The electrically controlled locking apparatus according to claim 4, wherein an end, away from the locking pin, of the pin shaft is fixedly connected with a blocking sheet.

6. The electrically controlled locking apparatus according to claim 5, wherein a blocking sheet detecting sensor is provided at each of two ends of a stroke of the blocking sheet rotating together with the pin shaft.

7. The electrically controlled locking apparatus according to claim 1, wherein an opening/closing state monitoring device is provided between the cover and the housing.

8. The electrically controlled locking apparatus according to claim 7, wherein the opening/closing state monitoring device comprises a supporting plate and a self-returning pressing sheet mounted on a surface, facing the cover, of the supporting plate;

the self-returning pressing sheet is rotatably provided on the supporting plate via a rotating shaft, and comprises one end extending towards the cover and forming a pressing end and the other end forming a detecting end; the rotating shaft is located between the pressing end and the detecting end; and a detecting sensor is provided in a stroke of the detecting end rotating around the rotating shaft.

9. The electrically controlled locking apparatus according to claim 8, wherein the self-returning pressing sheet realizes a self-returning function via a torsion spring coaxially provided relative to the self-returning pressing sheet.

10. The electrically controlled locking apparatus according to claim 6, wherein the control portion sends an operation instruction or an alarm signal according to a signal sent from the blocking sheet detecting sensor or the opening/closing state monitoring device.

11. The electrically controlled locking apparatus according to claim 7, wherein the control portion sends an operation instruction or an alarm signal according to a signal sent from the blocking sheet detecting sensor or the opening/closing state monitoring device.

* * * * *